United States Patent [19]

Klayer

[11] 4,412,842

[45] Nov. 1, 1983

[54] COAL BENEFICIATION PROCESS

[75] Inventor: Charles W. Klayer, Louisville, Ky.

[73] Assignee: Eric Charles Cottell, Bayvill, N.Y.

[21] Appl. No.: 223,612

[22] Filed: Jan. 9, 1981

Related U.S. Application Data

[63] Continuation of Ser. No. 33,640, Apr. 26, 1979, abandoned, which is a continuation of Ser. No. 888,356, Mar. 20, 1978, abandoned.

[51] Int. Cl.[3] ..... C10L 9/02; C10L 1/32

[52] U.S. Cl. ..... 44/1 SR; 44/51; 241/20

[58] Field of Search ..... 44/1 R, 1 SR, 51; 208/8; 241/20

[56] References Cited

U.S. PATENT DOCUMENTS

| | | | |
|---|---|---|---|
| 2,162,200 | 6/1939 | Kiesskalt et al. | 44/51 |
| 3,577,337 | 5/1971 | Kessler et al. | 208/8 |
| 3,640,016 | 2/1972 | Lee et al. | 44/1 R |
| 4,052,169 | 10/1977 | Cole et al. | 44/1 R |
| 4,054,506 | 10/1977 | Hart, Jr. et al. | 208/11 LE |
| 4,090,853 | 5/1978 | Clayfield et al. | 44/51 |
| 4,156,593 | 5/1979 | Tarpley, Jr. | 44/1 SR |
| 4,326,855 | 4/1982 | Cottell | 44/51 |

*Primary Examiner*—Carl F. Dees

[57] ABSTRACT

Coal is beneficiated by slurrying coal particles of less than 200 microns in diameter with water. The slurry is cavitated with intense sonic agitation at a level of at least 15 joules/cm$^2$. While the slurry is in the cavitated state, impurities and water are gravitationally separated from the slurry to produce a coal/water mixture having up to 40 percent by weight water, and preferably, 20 to 35 percent water with the balance coal.

10 Claims, 3 Drawing Figures

COAL BENEFICIATION PROCESS

This is a continuation of application Ser. No. 33,640, filed Apr. 26, 1979, which was a continuation of application Ser. No. 888,356, filed Mar. 20, 1978, both now abandoned.

BACKGROUND OF THE INVENTION

1. Field of the Invention

This invention relates to a method of beneficiating fine particulate coal and more particularly to a method of beneficiating coal through an aqueous slurry technique with subsequent water removal.

2. Description of the Prior Art

The burning of fine particulate coal by atomization has found acceptance as a method of more fully utilizing coal resources. Because coal having a particle size of 200 microns or less is finely divided, it has a large surface area which aids in its complete combustion. Further, finely divided coal has a high degree of porosity, and when the pores are impregnated with water and the coal is subsequently burned, the water superheats and explodes the coal particle thus providing more surface area for efficient burning. The impregnation of the coal with water has presented problems in that large amounts of water, i.e., about 80 percent, have been used to slurry and impregnate the coal. The separation of the water to obtain a high coal product has been accomplished by pumping the coal into settling ponds, allowing the coal to flocculate, and pumping off the excess water. Obviously this process involves time and space and has many undesirable characteristics.

In a similar process exemplified by U.S. Pat. No. 3,941,552, a process for forming an emulsion of water, oil and coal is provided which includes treating a slurry of the three constituents in an ultrasonic reactor to form a stable emulsion. This emulsion is subsequently burned in an oil type burner.

In accordance with the present invention, a process for the beneficiation of coal is provided which washes the coal during slurrying, impregnates the coal and concentrates the slurry to a high coal content.

BRIEF DESCRIPTION OF THE INVENTION

Coal is beneficiated by slurrying coal particles of less than 200 microns in diameter with water. The slurry is cavitated with intense sonic agitation at a level of at least 15 joules/cm$^2$. While the slurry is in the cavitated state, impurities and water are gravitationally separated from the slurry to produce a coal/water mixture having up to 40 percent by weight water, and preferably, 20 to 35 percent water with the balance coal.

DETAILED DESCRIPTION OF THE INVENTION

Coal fines or "run of the mine" coal may be used as the starting coal. The coal fines are usually less than 200 microns so that they may be slurried directly with water. In the case of "run of the mine" coal, the coal must be crushed by a hammer mill, cage mill or the like, to obtain coal having a particle size of less than 200 microns.

The particulate coal is mixed, normally in line, with water while being transferred to a slurrying apparatus. The normal ratio of coal to water is in the range of 65 to 90 parts water and 10 to 35 parts coal, and more preferably, 75 to 85 parts water and 15 to 25 parts coal. In the slurrying apparatus the coal and water are agitated to obtain an unstable homogeneous mixture of water and coal. A typical slurrying apparatus is a vacuum dispersion mixer, however, similar mixers providing adequate agitation may be used.

After slurrying the coal and water, the slurry is subjected to violent agitation and preferably, sonic agitation. As used herein the term "sonic" includes ultrasonic and contemplates within its scope frequencies in the range of 5,000 to 30,000 HZ. The sonic agitation must be sufficiently intense to produce strong cavitation of the slurry. The intensity provided for the cavitation required by the process of the invention is a minimum of 15 joules per square centimeter. There is no upper limit on the intensity to provide cavitation, save practicality and economics which set the maximum at 60 joules per square centimeter.

The sonic agitation is provided by a sonic probe having a generator, converter, and transducer associated therewith which converts electricity to metal vibration through a piezoelectric magneto strictive device. A particularly useful sonic agitation device is Model T-360 manufactured by Branson Sonic Power Company, which when coupled with a converter or transducer produces vibrations with an associated metal horn. The tip of the horn is placed in the slurry thus transferring the sonic vibrations thereto, cavitating the slurry. Opposing the horn is a metal plate upon which the slurry flows, normally the spacing between the horn and the metal plate is required to be twice the diameter of the largest coal particles, and preferably larger, and in the specific example hereinafter set forth, the spacing is $\frac{3}{8}$ inches and in some instances may be as great as 2 inches.

The high intensity agitation cavitates the slurry and further breaks the coal particles into even smaller particles. Additionally, the cavitation causes the impregnation of the coal surface with water to provide for higher efficiency in the subsequent burning process. While the slurry is still cavitated, water is removed therefrom and mineral impurities are preferably removed.

The water and impurities are removed by gravitational separation in a hydrocyclone or similar apparatus and subsequent treatment with a centrifugal drier.

The cleaned coal is recovered and the coal/water mixture contains about up to 40 percent, preferably 20 to 35 percent, by weight water based on the weight of the coal. The cleaned coal may be pelletized and burned. In addition to pelletizing, the coal may be burned by suspending it in semistable slurry with fuel oil. Although the particular ratio of fuel oil to coal is a matter of choice, a preferred slurry is three parts beneficiated coal to one part oil by weight. The slurry can then be pumped into a burner particularly adapted to burn heavy oils.

In addition to the process hereinbefore described, pulverized lime may be added along with the coal, slurried and agitated therewith. Preferably, three times the stoichiometric amount of lime is added to react with the sulphur constituent. Upon burning, the lime reacts with the sulphur oxides and hydration products thereof to form gypsum which may be removed by conventional dry precipitation processes. The addition of lime obviates or reduces the need of wet scrubbing to meet environmental pollution standards for burning coal.

The following drawings will more fully illustrate the principles and apparatus used in the practice of the invention.

DETAILED DESCRIPTION OF THE DRAWINGS

Figure 1:
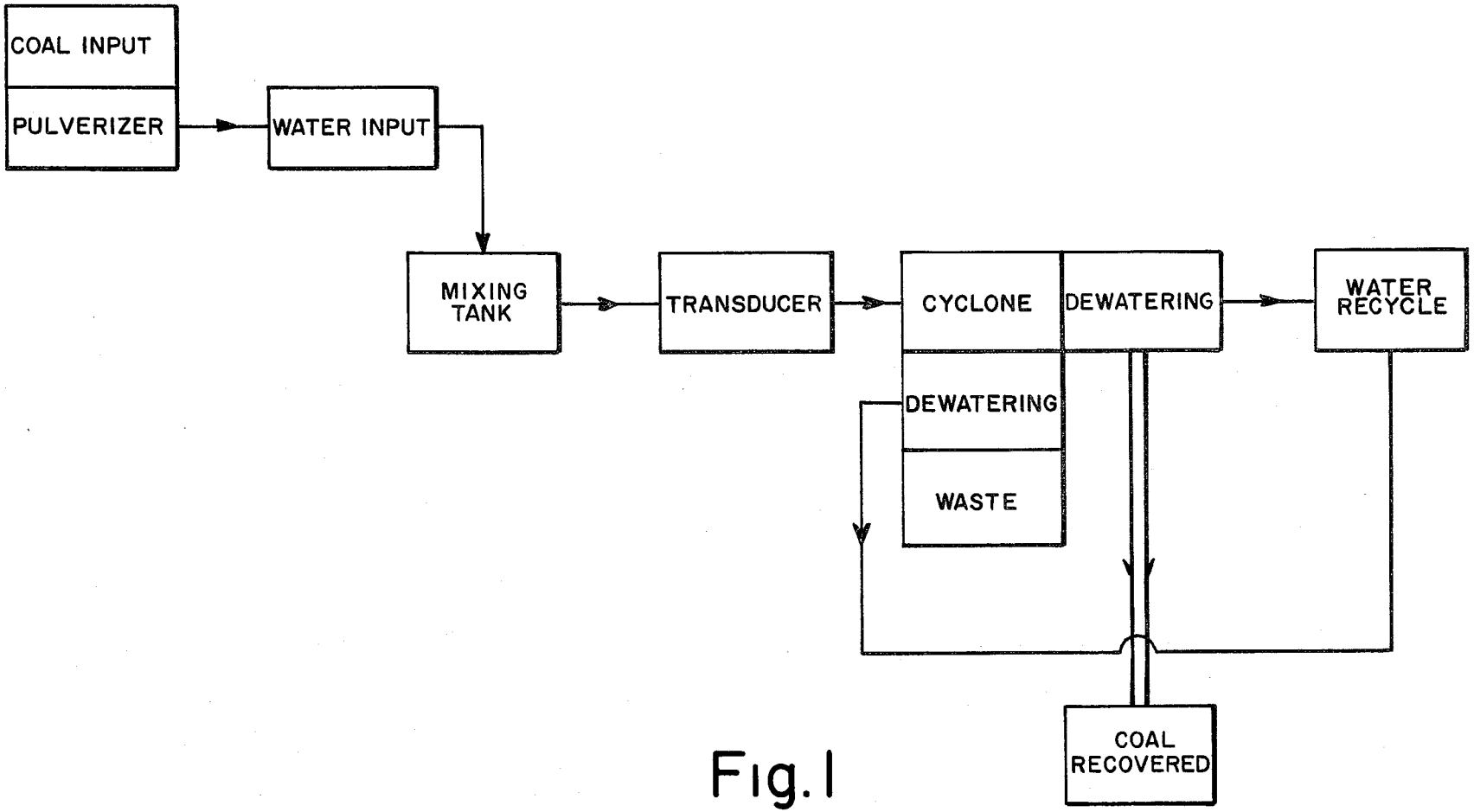
FIG. 1 is a diagram showing the general processing techniques and apparatus used in the practice of the invention.

Referring now to FIG. 1, the coal of varying size is placed in the coal input and optionally the lime can be charged therewith. From the coal input the pulverizer pulverizes the coal to the desired particle size, i.e., below 200 microns. From the pulverizer the coal is mixed with water in a range of 10 to 35 percent coal to 65 to 90 percent water, all by weight. The water may be fed either in line while transferring the coal to the mixing tank or may be charged directly to the mixing tank. An unstable slurry is formed in the mixing tank and from the mixing tank the slurry is passed to a sonic transducer which cavitates the slurry imparting high agitation thereto. Although a sonic transducer is shown, other high speed agitation techniques may be used. While the slurry is cavitated, it is passed to a hydrocyclone which gravitationally separates the coal from a major portion of the water and waste products such as non-carbonaceous minerals implanted within the coal. In the de-watering stage further water is removed by centrifugal separators or similar apparatus. Preferably, the slurry from the cyclone is still cavitated and where necessary, a second transducer may be interposed between the cyclone and the de-watering step to renew or intensify the cavitation initially imparted by the first transducer. Preferably, the water removed is recycled to the water input. The recovered coal may then be pelletized or slurried with oil for subsequent burning.

Figure 2:
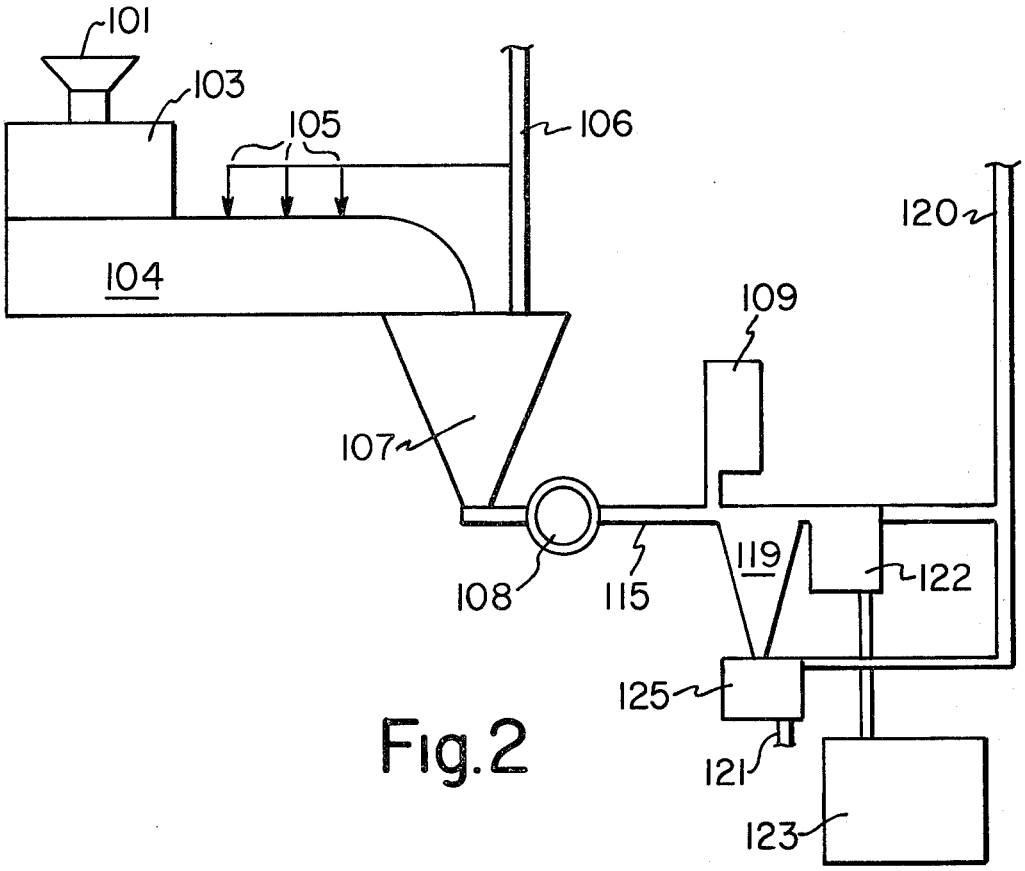
FIG. 2 is a process diagram showing an apparatus actually used in performing the process of the invention.
Figure 3:
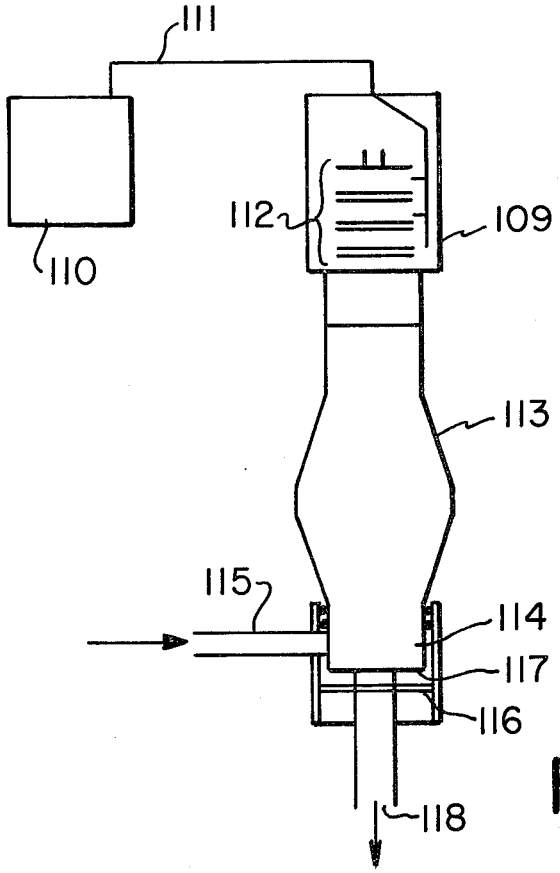
FIG. 3 shows an enlarged view of the sonic agitator of FIG. 2.

Referring now to FIG. 2, coal is charged to a hopper 101 and optionally, lime is charged therewith. From coal input 101 coal is passed to a hammer or cage mill 103 which pulverizes the coal to the desired particle size, i.e., 200 microns or less. From the hammer or cage mill 103, the coal is transferred to a slurrying tank and in this embodiment, by a screw conveyor 104. Preferably, some of the requisite water is added to the coal in the screw conveyor 104 through water input 105 in order to wet the coal to prevent ignition of the coal within the system. In the slurry tank the remainder of the water, i.e., 10 to 90 percent of the total water, is added through water source 106 and into the slurrying apparatus 107. In this particular embodiment, a preferred slurrying system is a twin screw vacuum mixer, which slurries the coal to form an unstable slurry. From the mixer 107 a pump 108 transfers the coal to the transducer 109 which is shown in an enlarged view in FIG. 3.

The transducer 109 is composed of a generator 110 which transfers current through a cable 111 to a piezoelectric magneto strictive 112 producing vibrations in the sonic range imparting such vibrations to horn 113 and subsequently to horn lip 114. The slurry passing through input 115 passes between horn lip 114 and steel plate 116. The coal particles within the slurry are thereby impregnated with water and further reduced in particle size by the cavitation imparted by the sonic vibration. Preferably, the space between horn lip 114 and steel plate 116, designated as space 117, is twice the particle size of the coal, i.e., in this embodiment, about 400 microns. The cavitated slurry is passed through outlet 111 into hydrocyclone 119 which separates a substantial amount of the non-carbonaceous mineral wastes and some of the water which was added to slurry the coal. The amount of combined water and non-carbonaceous impurities removed by the hydrocyclone constitutes about 20 to 30 percent by weight of the initial slurry. A minimal amount of coal is removed along with the impurities during cyclonic separation. Non-carbonaceous mineral waste is passed from the cyclone into a de-watering chamber such as a centrifugal separator 125, and the water is decanted and passed to return water outlet 120 for recycling. The dried waste is then disposed of through outlet 121. The slurry reduced in water content is passed through a de-watering chamber 122 while still in the cavitated state. If sufficient cavitation is not provided by the first transducer 109, a second transducer imparting cavitation to the slurry may be interposed between hydrocyclone 119 and de-watering apparatus 122. The de-watering apparatus is similar to that used for the waste and is preferably a centrifugal separator. The water removed in the de-watering process is passed into return water conduit 120 for recycling. The de-watered coal having 20 to 35 percent by weight of water therein is discharged into container 123 and may be then pelletized or slurried with oil or any other subsequent process.

The water/coal composition produced in accordance with the invention is cleaned by the process and further, has water implanted in the surface thereof. The water is superheated within the pores and the coal explodes into even finer particles for efficient burning. Prior to the invention disclosed herein, it was necessary to pump the coal fines used in the hereinbefore described process into settling ponds so that the coal could flocculate over long periods of time. The water would be pumped out and the coal fines would be recovered. However, even in accordance with this prior art process, the advantage of having the water implanted in the coal particles was not obtained. Thus, the invention provides not only a method of utilizing finely divided coal, but also a method of cleaning it and preparing it for efficient burning.

I claim:

1. A method of beneficiating coal which has non-carbonaceous impurities; comprising:

(a) rendering coal to particles of less than 200 microns in diameter;

(b) forming an aqueous slurry consisting of said coal particles of less than 200 microns in diameter and water;

(c) then cavitating said slurry with intense agitation at a level of at least 15 joules/cm$^2$ to thereby further break the coal particles into smaller particles and to impregnate the particles with water and concentrating said slurry while the slurry is still in a cavitated state to a mixture having up to 40% water to thereby remove a portion of the water and non-carbonaceous impurities from the slurry.

2. The method of claim 1 wherein said cavitation is provided by sonic agitation.

3. The method of claim 1 wherein said sonic agitation is in the range of 5,000 to 30,000 HZ.

4. The method of claim 1 wherein said agitation is at a level of up to 60 joules/cm$^2$.

5. The method of claim 1 including pulverizing lime with said coal.

6. The method of claim 1 including separating non-carbonaceous mineral impurities from said coal during gravitational concentration.

7. The method of claim 1 wherein said gravitational separation is accomplished by a hydrocyclone and a de-watering apparatus.

8. The method of claim 1 wherein the coal/water mixture has from 20 to 35 percent by weight water.

9. A method of beneficiating coal which has non-carbonaceous impurities comprising; forming an aqueous slurry consisting of coal particles and water, cavitating the slurry with intense agitation to break the coal particles into small particles and to impregnate the particles with water and to break off non-carbonaceous impurities from the coal particles, gravitationally separating the coal particles from a major portion of the water and non-carbonaceous impurities while the slurry is in a cavitated state, slurrying the coal and minor portion of water with oil, said method including the preliminary step of wetting the coal particles prior to forming the aqueous solution.

10. A fuel consisting essentially of only coal, oil and water resulting from the steps of: forming a slurry consisting of coal particles and water, cavitating the slurry with intense agitation to break the coal particles into small particles and to impregnate the particles with water and to break off non-carbonaceous impurities from the coal particles, gravitationally separating the coal particles from a major portion of the water and non-carbonaceous impurities while the slurry is in a cavitated state, and slurrying the coal and minor portion of water with oil.

* * * * *